US006339401B2

(12) United States Patent
Oshiyama

(10) Patent No.: US 6,339,401 B2
(45) Date of Patent: Jan. 15, 2002

(54) ANTENNA FOR PORTABLE RADIO

(75) Inventor: Tadashi Oshiyama, Yoshioka-Machi (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 09/733,982

(22) Filed: Dec. 12, 2000

(51) Int. Cl.[7] ..... H01Q 1/24
(52) U.S. Cl. ..... 343/702; 343/850
(58) Field of Search ..... 343/702, 850, 343/900; 455/90

(56) References Cited

U.S. PATENT DOCUMENTS 5,686,927 A * 11/1997 Simmons ..... 343/702
6,052,089 A * 4/2000 Eggleston ..... 343/702

FOREIGN PATENT DOCUMENTS

JP 61-21110 2/1986
JP 61-140608 8/1986
JP 61-154007 9/1986
JP 63-75970 5/1988

* cited by examiner

*Primary Examiner*—Don Wong
*Assistant Examiner*—James Clinger
(74) *Attorney, Agent, or Firm*—Dickstein Shapiro Morin & Oshinsky LLP

(57) ABSTRACT

A holder is eliminated when installing an antenna to a radio case, the installation operation is simplified, and a feeding mechanism is improved. A slit is provided in a stopper of an antenna so that the outer diameter can be reduced, and the antenna is inserted directly into a cylindrical section of the radio case from the bottom of the stopper. A plate-like feeding spring is provided at the cylindrical section, and is directly attached to a connection point of a circuit substrate of a radio; one end of the plate-like feeding spring pressingly contacts the side of the stopper of the antenna, thereby forming a feeding mechanism.

11 Claims, 5 Drawing Sheets

ANTENNA FOR PORTABLE RADIO

BACKGROUND OF THE INVENTION

1. Field of the Invention

The present invention relates to an antenna which is provided in a portable radio, represented primarily by devices for mobile communication terminal such as a portable telephone, PHS (Personal Handy Phone System), and the like. In particular, this invention relates to the antenna for portable radio which is installed to a case of the portable radio and can be freely extracted and stored therefrom/therein.

2. Description of the Related Art

An antenna which can be extracted during use, and stored inside the case of the radio when not in use, is used in this type of portable radio. Such a storable antenna comprises (a) a rod antenna section having a predetermined wavelength (one-quarter, three-eighths, one-half, etc.) when extracted from the radio case, and (b) a coil antenna section which is provided in an insulated state at the tip of the rod antenna section, and has a predetermined wavelength when projected from the radio case while the rod antenna is being stored. A feeding mechanism is provided at the antenna installation position on the radio case. The feeding mechanism electrically connects to the bottom end of the rod antenna section when the rod antenna is extracted, and electrically connects to the bottom end of the coil antenna section when the rod antenna is stored.

A conventional example of the feeding mechanism described above will be explained based on FIGS. 8 and 9. Firstly, the basic constitution of the antenna will be explained based on FIG. 8. As already explained, an antenna 1 comprises a coil antenna section 10 and a rod antenna section 20. A sleeve 12 of conductive material is provided as a feeding member at the base of the coil antenna section 10, which is provided at the tip of the antenna 1. A stopper 22 of conductive material is provided at the base of the antenna as a feeding member of the rod antenna section 20, which connects to the base of the sleeve 12. The coil antenna section 10 is provided at the tip of the antenna 1, and comprises a coil element 14 which is wound around a cylindrical bobbin 13 provided inside a top 11. The coil element 14 is electrically connected to the sleeve 12, which is coupled to the base of the top 11. The rod antenna section 20 comprises a flexible antenna tube 21 having elasticity which covers an antenna element 23. The antenna element 23 connects to the base of the stopper 22, provided at the base of the antenna.

When manufacturing the antenna 1, a holder 30 is attached while the stopper 22 is in the fastened state. The holder 30 comprises a conductive member. A screw section 30*a* is provided around the outer rim of the holder 30, and a groove 30*b* for a screw-stopping fitting is provided in a flange-like head section. A holding spring 31 is provided inside the holder 30, and maintains electrical contact with the stopper 22 and the sleeve 12. FIG. 9 shows the state when the antenna 1 is attached to the radio case 2 by the holder 30. An installation metal fitting 32 has a screw section in its inner rim, and is provided at the antenna installation position on the case 2. The screw section 30*a* around the holder 30 screws into the screw section in the installation metal fitting 32. A special fitting 40, such as that shown in FIG. 10, is inserted into the groove 30*b* at the head of the holder 30 and clamping is carried out. A feeding spring 33 is connected to the installation metal fitting 32, and electricity is supplied via the feeding spring 33 to a radio circuit board comprising an RF substrate 4. A storage cylinder 34 is provided below the installation metal fitting 32.

The conventional feeding mechanism in the antenna 1 described above has the following problems. Firstly, electrical contact resistance is high and signal transmission is unstable. According to the constitution described above, a received signal flows from the coil antenna and the rod antenna element 14 and 23, via the sleeve 12 or the stopper 22, the holding spring 31, the holder 30, the installation metal fitting 32, and the feeding spring 33, to the RF (Radio Frequency) substrate 4. Transmitted signals flow along the same route in reverse, passing from the RF substrate 4, via the feeding spring 33, the installation metal fitting 32, the holder 30, the holding spring 31, the sleeve 12 and the stopper 22, to the coil antenna and the rod antenna element 14 and 23. There are a great many contact points between the members which signals pass through during transmission, and consequently the electrical contact resistance becomes as high as 200 mΩ to 1 Ω. Furthermore, noise is liable to enter the signals at the contact points between the members during transmission, making signal transmission unstable.

Secondly, there is a serious problem regarding weight. Since portable radios such as mobile telephones and PHS, are often carried in users' pockets and the like, the total weight of the portable radio needs to be extremely light. However, in the conventional constitution described above, the weight of the main body of the antenna 1 (including the holder 30) with the addition of the installation metal fitting 32 is approximately 2.3 g. This is an impediment to making the portable radio lighter.

Thirdly, there is a problem of workability when attaching the antenna 1 to the radio case 2. In the above constitution, in attaching the antenna 1 to the radio, the holder 30 must be screwed to the installation metal fitting 32 of the radio. As shown in FIG. 10, this screwing operation requires the special fitting 40. In addition, the torque of the clamping must be controlled, making this operation bothersome. Furthermore, there is a possibility that the groove 30*b* for joining the fitting will be damaged during the screwing operation. Moreover, the presence of the groove 30*b* for joining the fitting leads to a problem that the antenna tube 21 of the rod antenna section might be damaged by touching the edges of the groove.

Fourthly, there is a problem of variation in the sliding forces of the holding spring 31 and the sleeve 12 or the stopper 22. In the conventional mechanism, the holding spring 31 must be provided in a small limited space inside the holder 30. As a consequence, the holding spring 31 has a short contact piece length and little flexion. This results in an unstable sliding force between the holding spring 31 and the sleeve 12 (stopper 22), the sliding force varying between approximately 200 to 600 g.

Fifthly, the conventional feeding mechanism comprises so many components that the cost of the antenna 1 is high.

SUMMARY OF THE INVENTION

The present invention has been achieved in order to solve the above problems. It is an object of this invention to improve the feeding mechanism of the antenna by reducing the contact resistance, stabilizing signal transmission, reducing the weight of the antenna, simplifying the operation of installing the antenna, upholding product quality, and reducing costs.

In order to achieve the above objects, a first aspect of this invention provides an antenna for portable radio comprising an antenna section which functions when extracted from a case of a portable radio, and a stopper which comprises a feeding member and is provided at the base of the antenna section. The antenna can be freely extracted from and stored in the case. A cylindrical section is provided on the case at the antenna installation position, and the stopper reaches a clipped state after being inserted into the cylindrical section. The cylindrical section comprises a plate-like feeding spring which pressingly contacts one end of the feeding member when the feeding member faces inside the cylindrical section. The plate-like feeding spring holds the antenna section and feeds electricity when the antenna section is extracted.

A second aspect of this invention provides the antenna for portable radio of the first aspect, wherein the other end of the plate-like feeding spring connects to another element.

A third aspect of this invention provides the antenna for portable radio of the first aspect, wherein a slit is provided in the stopper so that the diameter of the stopper decreases during insertion into the cylindrical section and the stopper reaches a clipped state after insertion.

A fourth aspect of this invention provides the antenna for portable radio of the first aspect, wherein the stopper comprises an attachment section which a clipping member is attached to after insertion into the cylindrical section.

According to the above constitution, the antenna can be installed to the radio case without using a holder. A cylindrical section is provided at the position on the radio case where the antenna is installed, and, after the stopper of the antenna has been inserted into the cylindrical section, the stopper becomes securely clipped therein. Specifically, the stopper comprises a slit which allows the diameter of the stopper to be reduced during insertion into the cylindrical section. After the stopper has been inserted, the slit elastically opens, securely clipping the stopper. Alternatively, a clipping member may be provided for clipping the stopper in position after it has been inserted into the cylindrical section. Therefore, during normal use, the antenna is fastened to the cylindrical section so as to prevent from falling off and can slide in and out normally. When removing the antenna in the case of a malfunction or the like, the antenna can be pulled out of the cylindrical section by a force which is greater than a predetermined force (e.g. 10 kg.f).

According to the feeding mechanism of this constitution, the cylindrical section comprises a plate-like feeding spring. When the stopper or the sleeve faces the cylindrical section, one end of the plate-like feeding spring pressingly contacts the stopper or the sleeve. The other end of the plate-like feeding spring directly pressingly contacts the circuit substrate connection point of the radio.

According to this constitution, the holder of the conventional example is removed and the stopper of the antenna is directly attached to the side of the case. Therefore, the complexity of affixing the holder by screwing can be eliminated. In addition, damage to the antenna tube caused by a fitting groove of the holder can be eliminated. The feeding mechanism comprises a plate-like feeding spring which jointly provides the functions of the conventional holding spring and feeding spring, and feeds electricity from the feeding member of the antenna, via the plate-like feeding spring, and directly to the circuit substrate. Therefore, the feeding mechanism has few electrically contacting parts, reducing the contact resistance and contact noise, thereby stabilizing signal transmission. Further, since there are few restrictions on space, the feeding member of the antenna can have a sufficient contact piece length. Consequently, the pressing contact force of the spring can be stabilized, enabling a stable sliding force to be applied to the stopper and the sleeve inside the cylindrical section.

Further, this invention comprises fewer components at the attachment point of the antenna and the radio case, and in the feeding mechanism, than the conventional example. Therefore, the cost and weight can be reduced.

DESCRIPTION OF THE PREFERRED EMBODIMENTS

Figure 1A:
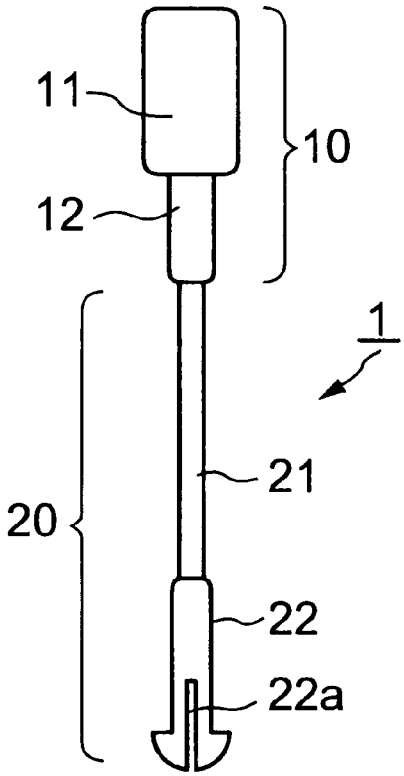
FIGS. 1A and 1B are external views of an antenna 1, FIG. 1A being a front view, and Fig. 1B, a bottom view.
Figure 1B:
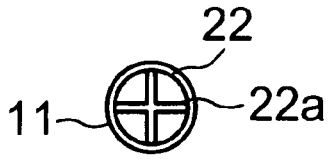

A preferred embodiment of this invention will be explained with reference to the drawings. FIGS. 1A and 1B are external views of an antenna 1 according to this embodiment, FIG. 1A being a front view, and FIG. 1B, a bottom view. Since the basic constitution of the antenna 1 is no different from that of the conventional example which has already been explained, the same reference codes are appended and detailed explanation is omitted. The antenna 1 broadly comprises a coil antenna section 10 and a rod antenna section 20, the coil antenna section 10 comprising a top 11 and a sleeve 12, and the rod antenna section 20 comprising an antenna tube 21 and a stopper 22. In this embodiment, the shape of the stopper 22 is such that its diameter can be elastically reduced. That is, a slit 22*a* is provided in the bottom of the stopper 22, enabling the outer diameter of the stopper 22 to be reduced by peripheral pressure. When the peripheral pressure is withdrawn, the elasticity of the stopper 22 returns it to its original diameter. This example shows a four-segment slit, but the constitution is not restricted to this, and a two-segment or three-segment slit is also acceptable.

Figure 2:
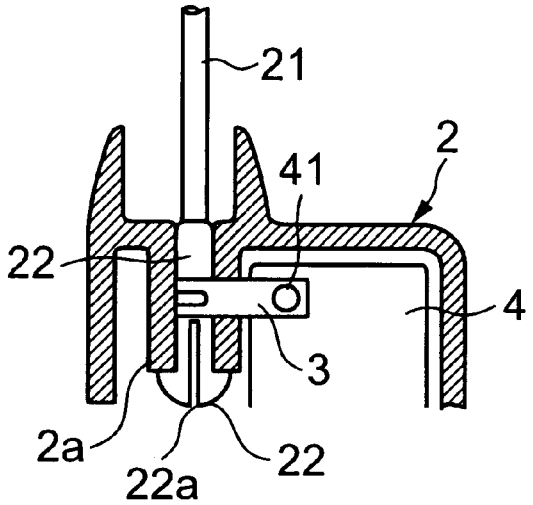
FIG. 2 is a partial cross-sectional view of the antenna 1 attached to a radio case 2.

FIG. 2 is a partial cross-sectional view of the state when the antenna 1 is attached to a radio case 2. A cylindrical section 2*a* is provided on the radio case 2 during manufacture. The inner diameter of the insertion hole of the cylindrical section 2*a* is slightly larger than the outer diameter of the sleeve 12 and the outer diameter of the stopper 22 when the diameter of the stopper 22 is reduced by pressing. The inside of the cylindrical section 2*a* may be metallic in order to increase its pulling strength and its durability against the sliding of the sleeve 12 and the stopper 22.

Figure 3:
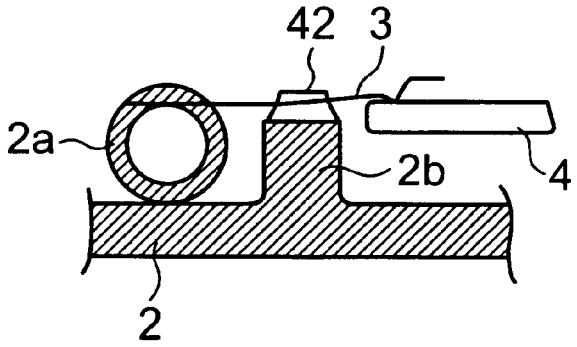
FIG. 3 is a diagram showing an example of attaching a plate-like feeding spring 3.

In FIG. 2, a plate-like feeding spring 3 is attached to the cylindrical section 2*a* in such a manner that one end of the spring 3 faces the inside of the insertion hole and the other end pressingly contacts the connection point of a circuit substrate (RF substrate). The plate-like feeding spring 3 may be attached by securing its other side directly to the circuit substrate by using a stopping pin 41 as shown in FIG. 2, or by providing a boss 2*b* on the case 2, securing the center of the plate-like feeding spring 3 to the boss 2*b* by using a stopping pin 42, providing one end of the plate-like feeding spring 3 facing toward the insertion hole of the cylindrical section 2*a,* and pressingly contacting the other end to the connection point of the RF substrate 4 as shown in FIG. 3. In order to provide one end of the plate-like feeding spring 3 facing the insertion hole of the cylindrical section 2*a,* a hole having a vertical length corresponding to the width of the plate-like feeding spring 3 is provided in the side face of the cylindrical section 2*a*. This hole is no wider than necessary to allow the sleeve 12 or the stopper 22 of the antenna 1 to touch the plate-like feeding spring 3 and be elastically deformed.

In FIGS. 2 and 3, the other side of the plate-like feeding spring 3 pressingly contacts the RF substrate 4, but it may contact another element such as, for instance, a built-in antenna.

When attaching the antenna 1 to the radio case 2, the antenna 1 need only be pushed into the insertion hole in the cylindrical section 2*a* from below the stopper 22. When the antenna 1 is pushed into the insertion hole in the cylindrical section 2*a* from below the stopper 22, the action of the slit 22*a* reduces the outer diameter of the stopper 22, thereby enabling it to pass through the insertion hole. When the stopper 22 is pushed completely into the insertion hole, the elasticity of the slit 22*a* widens the diameter of the bottom end of the stopper 22, thereby clipping the stopper 22 into the cylindrical section 2*a*.

When the antenna 1 has been attached to the cylindrical section 2*a,* the sleeve 12 or the stopper 22 of the antenna 1 is facing the cylindrical section 2*a* and one end of the plate-like feeding spring 3 pressingly contacts the side of the sleeve 12 or the stopper 22. The plate-like feeding spring 3 must be wide enough to have sufficient contact piece length that it obtains a stable sliding force against the sleeve 12 or the stopper 22, and can maintain a reliable and stable electrical contact with the sleeve 12 or the stopper 22. The plate-like feeding spring 3 can be set to a sufficient width, since there are few restrictions on its attachment space. By way of example, metal-plated beryllium copper having a contact piece length of 10 mm and thickness of 2.2 mm achieves a stable sliding force of between 150 to 220 g.

The spring tension of the plate-like feeding spring 3 must be set so that it has enough pressing force to hold the stopper 22 and the sleeve 12 inside the cylindrical section 2*a* when the antenna 1 is extracted and stored. The plate-like feeding spring 3 does not have to be a one-layer spring as in FIG. 2, and may comprise a two-layer or three-layer spring, etc. The position of the plate-like feeding spring 3 is not limited to the horizontal position shown in FIG. 2, and it may be provided diagonally, vertically, etc.

Figure 4:
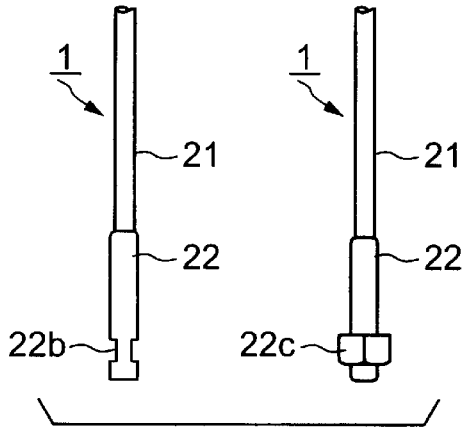
FIG. 4 is a diagram showing another embodiment relating to the shape of a stopper 22.
Figure 5:
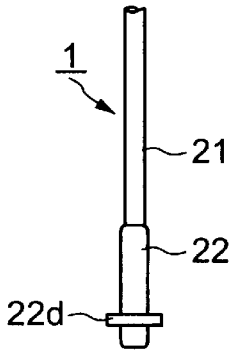
FIG. 5 is a diagram showing another embodiment relating to the shape of the stopper 22.
Figure 6:
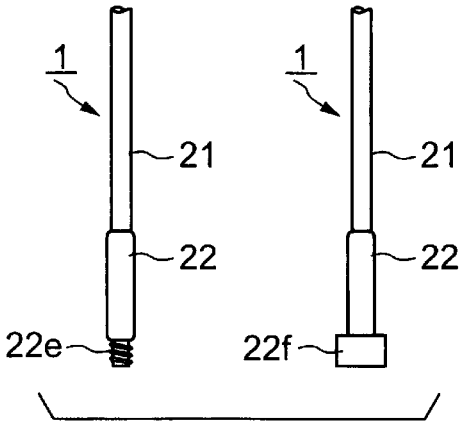
FIG. 6 is a diagram showing another embodiment relating to the shape of the stopper 22.

FIGS. 4 to 6 show other embodiments relating to the shape of the stopper 22. In the example of FIG. 4, a C-ring is used to prevent the stopper 22 from coming out. After the bottom of the antenna 1 has been inserted into the cylindrical section 2*a,* a clipping member comprising the C-ring 22*c* is provided in a clipping groove 22*b* of the stopper 22. The example of FIG. 5 has the same constitution as FIG. 4 except that an E-ring 22*d* is used as the clipping member. In the example of FIG. 6, a screw section 22*e* is provided at the bottom of the antenna. After the bottom of the antenna 1 has been inserted into the cylindrical section 2*a,* a fastening section 22*f* is screwed into the screw section 22*e*.

According to these embodiments, during normal use of the stopper 22, the antenna 1 is fastened to the cylindrical section 2*a* and can slide in and out normally. When removing the antenna 1 in the case of a malfunction or the like, the antenna 1 can be pulled out of the cylindrical section 2*a* by a force which is greater than a predetermined force (e.g. 10 kg.f). The feeding path runs from the coil antenna or rod antenna element to the sleeve 12 or the stopper 22, to the plate-like feeding spring 3, and then to the circuit substrate. Thus, there are far fewer contacting sections than in the conventional example described earlier. Therefore, according to these embodiments, the contact resistance is stable at below 100 m (. Since fewer nents are used at the antenna installation position and in the feeding mechanism, the antenna can be made much lighter than the conventional example.

As explained above, the operation of installing the antenna 1 is extremely simple, and no special fitting is needed. Removing the holder from the constitution eliminates the problems of damage to the groove for the holder fitting and damage to the antenna tube caused by the groove for fitting when the antenna slides. Therefore, quality control is easier than in the conventional example.

Figure 7:
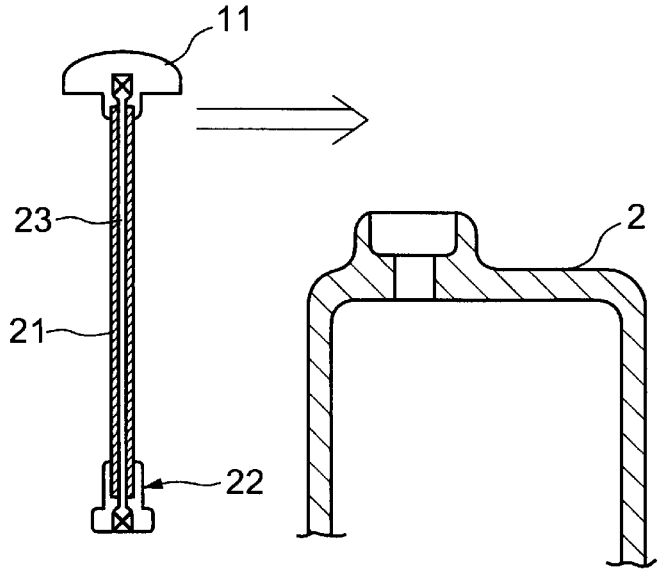
FIG. 7 is a diagram showing yet another embodiment of the state when the antenna is extracted from the radio case to the outside.
Figure 8:
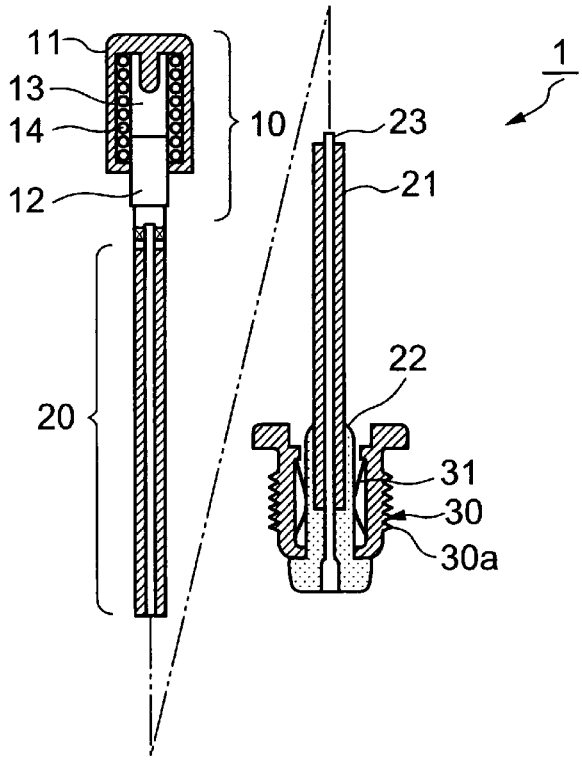
FIG. 8 is a diagram showing a basic constitution of an antenna.
Figure 9:
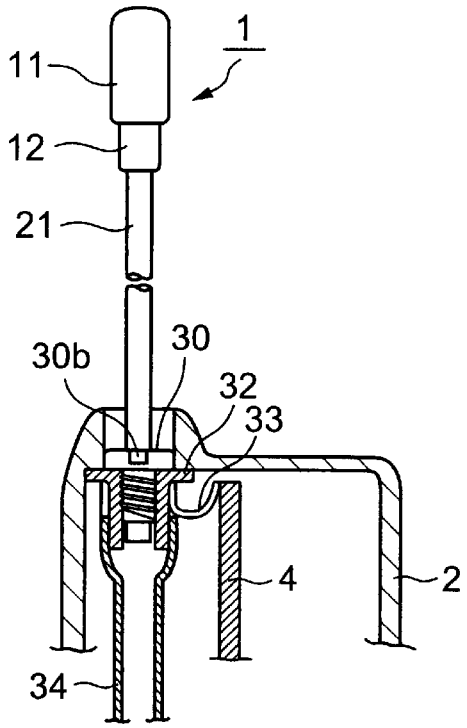
FIG. 9 is a diagram showing a conventional example.
Figure 10:
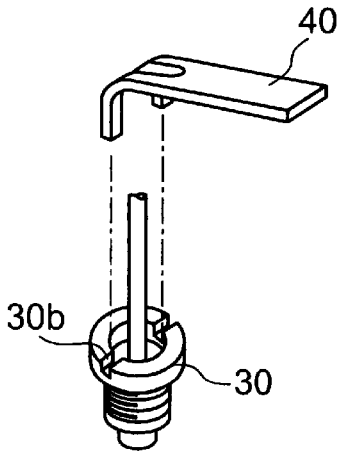
FIG. 10 is a diagram showing a conventional example.

FIG. 7 shows yet another embodiment of this invention. The embodiment shown in FIG. 7 differs from the previous embodiments in that it comprises a whip antenna corresponding to the rod antenna section 20, there being no coil antenna section. The stopper 22 is provided at one end of the whip antenna, and a resin top 11 is secured to the other end after the antenna element 23 has been extracted from inside the case 2 to the outside. Except for the fact that the inside and outside of the case are replaced, the assembly and finishing operations are basically no different from the embodiments which have already been described. The antenna element 23 normally comprises an NiTi (nickel titanium) round-headed rod covered by an antenna tube 21, the tip being flattened or the like in order to firmly secure the top 11 thereto.

PC (polycarbonate), ABS resin, POM (polyacetal), and the like, can be used as the material for the top 11 and the stopper 22 used in all the previous embodiments, including the embodiment of FIG. 7.

The present invention having the constitution described above obtains the following advantages.

(1) By removing the holder from the constitution when installing the antenna to the radio case, installation becomes simpler and problems of declining quality due the presence of the holder are eliminated.

(2) By simplifying the feeding mechanism between the antenna and the radio circuit, the number of components is greatly reduced. Therefore, the contact resistance of the feeding path is reduced, and stable signal transmission with low contact noise can be maintained.

(3) This invention uses a plate-like feeding spring which can maintain sufficient contact piece length with respect to the stopper and sleeve of the antenna. Therefore, a stable sliding force can be achieved against the stopper and the sleeve, and an appropriate holding force can be applied thereto.

(4) By reducing the number of components at the antenna installation position and in the feeding mechanism, the antenna can be made lighter.

What is claimed is:

1. An antenna assembly for a portable radio, said antenna assembly comprising:

an antenna section which functions when extracted from a case of said portable radio; and a stopper which comprises a feeding member and which is provided at a base side of the antenna section, the antenna section being freely extractable from and storable in said case wherein said stopper reaches a clipped state upon being inserted into a cylindrical section provided on said case, said cylindrical section comprising a plate-like feeding spring, a first end of which pressingly contacts one end of said feeding member when the feeding member is inserted within said cylindrical section, and wherein said first end of said plate-like feeding spring contacts said antenna section for conducting electricity when said antenna section is extracted.

2. The antenna for portable radio as described in claim 1, a second end of said plate-like feeding spring connecting to another element.

3. The antenna for portable radio as described in claim 1, a slit being provided in said stopper so that its diameter decreases during insertion into said cylindrical section and said stopper reaches a clipped state after insertion.

4. The antenna for portable radio as described in claim 1, said stopper comprising an attachment section which a clipping member is attached to after insertion into said cylindrical section.

5. An antenna assembly for a portable radio, the assembly comprising:

an antenna section having a stopper at a base end;

said stopper reaching a clipped state upon being inserted into a cylindrical section provided on a case of said portable radio, wherein said case further comprises a plate-like feeding spring, a first end of said plate-like feeding spring pressingly contacts one end of said stopper for conducting electricity from said stopper when the antenna section is extracted from said case.

6. The antenna assembly of claim 5, wherein said antenna section further comprises a sleeve at an end opposite said stopper, said first end of said plate-like feeding spring pressingly contacting one end of said sleeve for conducting electricity from said sleeve when the sleeve is stored in the case.

7. The antenna assembly of claim 5, wherein said stopper further comprises a slit at a bottom end, said slit enabling the reduction of the diameter of said stopper when peripheral pressure is applied to said stopper.

8. The antenna assembly of claim 5, wherein said stopper further comprises an attachment section for receiving a clipping member after said stopper is inserted in said cylindrical section.

9. The antenna assembly of claim 5, wherein said plate-like feeding spring conducts electricity between said stopper and a circuit substrate.

10. The antenna assembly of claim 6, wherein said plate-like feeding spring conducts electricity between said sleeve and a circuit substrate.

11. The antenna assembly of claim 5, further comprising a hole in a side face of the cylindrical section for enabling said first end of said plate-like feeding spring to contact said stopper.

* * * * *